US005585696A

United States Patent [19]

Koyama et al.

[11] Patent Number: 5,585,696

[45] Date of Patent: Dec. 17, 1996

[54] HIGH CURRENT DENSITY GLOW DISCHARGE SWITCH

[75] Inventors: Ken-ichi Koyama; Hideaki Toya, both of Amagasaki, Japan

[73] Assignee: Mitsubishi Denki Kabushiki Kaisha, Tokyo, Japan

[21] Appl. No.: 985,857

[22] Filed: Dec. 4, 1992

[30] Foreign Application Priority Data

Dec. 6, 1991 [JP] Japan ..... 3-323104

[51] Int. Cl.[6] ..... H01H 33/66

[52] U.S. Cl. ..... 315/111.41; 315/150; 315/338; 315/111.81; 315/111.21; 313/155; 313/161; 313/231.31; 219/123; 219/121.52; 204/298.16; 204/298.41

[58] Field of Search ..... 315/149, 150, 315/156, 157, 158, 159, 111.21, 344, 349, 338, 111.41, 111.81; 250/396 R, 492.22; 313/155, 161, 231.31; 218/118, 128; 219/123, 121.52; 204/298.16, 298.41

[56] References Cited

U.S. PATENT DOCUMENTS

| | | | |
|---|---|---|---|
| 3,089,936 | 5/1963 | Smith, Jr. | 200/279 X |
| 3,405,300 | 10/1968 | Wasa et al. | 315/344 |
| 3,517,256 | 6/1970 | Barbini | 315/156 |
| 3,522,399 | 7/1970 | Crouch | 200/279 X |
| 3,811,670 | 5/1974 | Voshall | 315/156 |

(List continued on next page.)

FOREIGN PATENT DOCUMENTS

| | | |
|---|---|---|
| 0113962A1 | 7/1984 | European Pat. Off. . |
| 0192251A3 | 8/1986 | European Pat. Off. . |
| 0199593A3 | 10/1986 | European Pat. Off. . |
| 3510981A1 | 10/1985 | Germany . |
| 3610245A1 | 10/1987 | Germany . |
| 4013903A1 | 11/1990 | Germany . |
| 50-52562 | 5/1975 | Japan . |
| 57-76713 | 5/1982 | Japan . |
| 61-195528 | 8/1986 | Japan . |
| 2111309A | 6/1983 | United Kingdom . |
| 2231723A | 11/1990 | United Kingdom . |

OTHER PUBLICATIONS

*Patent Abstracts of Japan,* vol. 16, No. 91 (E–1174), Mar. 5, 1992, JP–A–03 272 530.

*Patent Abstracts of Japan,* vol. 17, No. 608 (E–1457), Nov. 9, 1993, JP–A–05 190 062.

*Physics and Applications of Pseudosparks,* edited by M. A. Gundersen et al. (Plenum Press, New York, 1990), p. 6.

J. Christiansen et al., "Comparison of Electrode Effects in High–Pressure and Low–Pressure Gas Discharges Like Spark–Gap and Pseudospark Switch", *Physics and Applications of Pseudosparks,* edited by M. A. Gundersen et al. (Plenum Press, New York 1990), pp. 89–93.

G. Kirkman et al., "Recent Experimental Studies of the BLT Switch", *Digest of Technical Papers,* 7th IEEE Pulsed Power Conference, Monterey, CA Jun. 11–14, 1989, pp. 1–4.

*Primary Examiner*—Robert Pascal
*Assistant Examiner*—Arnold Kinkead
*Attorney, Agent, or Firm*—Burns, Doane, Swecker And Mathis

[57] ABSTRACT

The present invention is directed to a high current density glow discharge switch which is capable of preventing confinement of an electron current to the vicinity of the center of a flat electrode during the operation of the switch to prevent an increase in the temperature of the flat electrode and thereby provide a highly reliable and stable switch having a long lifetime. A cathode and an anode each include a flat electrode having a central hole and a cup-shaped electrode electrically connected to the flat electrode. The cathode and the anode are disposed such that the flat electrodes face each other. A cylindrical insulator is disposed on the outside of the cathode and the anode. A coil for generating a magnetic field is disposed on the outside of the cylindrical insulator. Hydrogen gas is sealed in a sealed space defined by the cylindrical insulator, the cathode and the anode.

9 Claims, 4 Drawing Sheets

U.S. PATENT DOCUMENTS

| | | | |
|---|---|---|---|
| 3,946,179 | 3/1976 | Murano et al. | 218/129 |
| 3,980,850 | 9/1976 | Kimblin | 200/144 B |
| 4,152,625 | 5/1979 | Conrad | 315/111.7 |
| 4,336,430 | 6/1982 | Kurosawa et al. | 218/129 |
| 4,430,536 | 2/1984 | Kurosawa et al. | 218/127 |
| 4,453,054 | 6/1984 | Peche et al. | 200/279 X |
| 4,473,731 | 9/1984 | Yorita | 218/123 |
| 4,512,867 | 4/1985 | Andreev et al. | 204/298 |
| 4,553,002 | 11/1985 | Slade | 218/128 |
| 4,584,445 | 2/1986 | Kashiwagi et al. | 218/130 |
| 4,588,879 | 5/1986 | Noda et al. | 218/127 |
| 4,667,070 | 5/1987 | Zuckler | 218/129 |
| 4,931,702 | 6/1990 | Voronin et al. | 315/344 |
| 4,935,588 | 6/1990 | Hess et al. | 218/123 |
| 4,978,893 | 12/1990 | Brannon et al. | 315/150 |
| 5,055,639 | 10/1991 | Schels et al. | 218/129 |

HIGH CURRENT DENSITY GLOW DISCHARGE SWITCH

BACKGROUND OF THE INVENTION

FIELD OF THE INVENTION

The present invention relates to a high current density glow discharge switch.

DESCRIPTION OF THE RELATED ART

FIG. 8 is a cross-sectional view illustrating a conventional high current density glow discharge switch described in, for example, RECENT EXPERIMENTAL STUDIES OF THE BACK LIGHTED THYRATRON SWITCH, DIGEST OF TECHNICAL PAPERS, P. 1–4, 7TH IEEE Pulsed Power Conference, 1989.

In the figure, reference numeral 1 denotes a flat electrode having a central aperture; and 2 denotes a cup-shaped electrode which is electrically connected to the flat electrode 1.

In the structure shown in FIG. 8, the pair of flat electrodes 1 face each other and are separated by a predetermined gap. One of the cup-shaped electrodes 2 is electrically connected to one of the flat electrodes 1 to form a cathode 3. Similarly, the other cup-shaped electrode 2 is electrically connected to the other flat electrode 1 to form an anode 4.

Reference numeral 5 denotes a space within the cathode; 6 denotes a space within the anode; 7 denotes a cylindrical insulator which is disposed on the outside of the cup-shaped electrodes 2 constituting the cathode 3 and the anode 4 and which forms, together with the cathode 3 and the anode 4, the sealed space; 8 denotes a window through which a light is emitted into the space 5 in the cathode to initiate discharge; 9 denotes a port from which the structure is evacuated and a gas is introduced into the structure; and 10 denotes an electron current which flows from the cathode 3 to the anode 4.

The operation of the conventional high current density glow discharge switch will be described below.

First, the sealed space formed by the cathode 3, the anode 4 and the cylindrical insulator 7 is evacuated to a predetermined degree of vacuum from the port 9, and then hydrogen gas, for example, is charged into the space.

In a state wherein a voltage is applied between the cathode 3 and the anode 4, a light is made incident into the space 5 in the cathode through the window 8 to generate electrons in the space 5 in the cathode 3.

As a result, a discharge occurs between the cathode 3 and the anode 4, and a current thus flows from the cathode 3 to the anode 4 due to an electron current 10.

At that time, since the space 5 in the cathode is formed by the flat electrode 1 and the cup-shaped electrode 2, a large-scaled electron emission occurs in the space 5 in the cathode, and a high density electron current 10 is thus obtained.

In the thus-arranged conventional high current density glow discharge switch, the electron current 10 which flows in the discharge generated between the cathode 3 and the anode 4 tends to be confined to the vicinity of the central axis of each of the flat electrodes 1 constituting the cathode 3 and anode 4. Consequently, the current value further increases or confinement of the electron current 10 is accelerated due to the self-pinch effect of the electron current 10 where the energization time is prolonged. As a result, the surface temperature of each of the flat electrodes 1 constituting the cathode 3 and the anode 4 may increase, increasing the damage to the flat electrode 1. Also, the electrode substance may be attached to the inner wall surface of the cylindrical insulator 7, degrading the discharge initiation characteristics and the insulation characteristics and thus reducing the lifetime of the switch.

SUMMARY OF THE INVENTION

Accordingly, an object of the present invention is to provide a highly reliable, durable and stable high current density glow discharge switch which enables confinement of an electron current to be restricted even when the current value increases or the energization time is increased so as to reduce damage to the flat electrode and prevent attachment of an electrode substance to the cylindrical insulator.

In order to achieve the above object, according to one aspect of the present invention, there is provided a high current density glow discharge switch which is characterized by the inclusion of a magnetic field generation means for generating a magnetic field between a cathode and an anode substantially parallel to a direction in which electrons flow from the cathode to the anode during the operation of the switch.

According to another aspect of the present invention, there is provided a high current density glow discharge switch which is characterized in that a slit is provided in a side wall portion of each of cup-shaped electrodes constituting a cathode and an anode to divide the side wall portion and thereby define a current path which ensures that a current flowing in the side wall portion has a component in the circumferential direction of the cup-shaped electrode.

In the present invention, a magnetic field generated by the magnetic field generation means is distributed over the entire surface of each of the flat electrodes constituting the cathode and the anode. Since the electrons directed from the cathode to the anode move along the lines of magnetic force in this magnetic field, the electron current is diffused over the surface of the flat electrode, and the confinement of the electron current to the vicinity of the center of the flat electrode is thus restricted.

Furthermore, the side wall portion of each of the cup-shaped electrodes constituting the cathode and the anode is divided by a slit to define a current path which ensures that the current flowing in the side wall portion has a component in the circumferential direction of the cup-shaped electrode. Thus, when a current flows in the switch, a current component in the circumferential direction of the cup-shaped electrode is generated in the current path in the side wall portion of the cup-shaped electrode without the need for a special magnetic field generation means, thereby generating a magnetic field between the cathode and the anode substantially parallel to the direction in which the electrons which flow from the cathode to the anode.

DETAILED DESCRIPTION OF THE PREFERRED EMBODIMENTS

Embodiment of the present invention will now be described with reference to the accompanying drawings.

Figure 1:
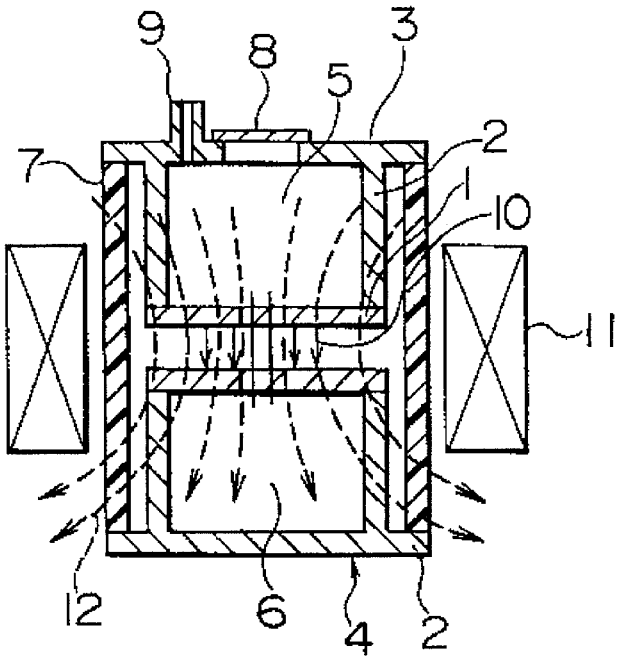
FIG. 1 is a cross-sectional view of a high current density glow discharge switch showing a first embodiment of the present invention.
Figure 2:
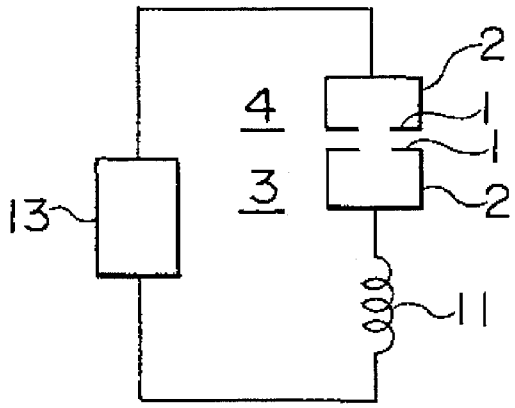
FIG. 2 is a circuit diagram of an equivalent circuit showing an electrically connected state of the high current density glow discharge switch of FIG. 1.

FIG. 1 is a cross-sectional view of a high current density glow discharge switch illustrating a first embodiment of the present invention. FIG. 2 is a circuit diagram of an equivalent circuit illustrating an electrical connection in the switch shown in FIG. 1. Identical reference numerals in these figures to those in FIG. 1 represent similar or identical elements.

In the figures, reference numeral 11 denotes a coil, serving as the magnetic field generation means, disposed on the outer side of the cylindrical insulator 7 to generate a magnetic field between the cathode 3 and the anode 4; 12 denotes lines of magnetic force generated by the coil 11; and 13 denotes a power source.

In this embodiment, the coil 11 is connected to the cathode 3 so that a current flowing from the power source 13 to the cathode 3 and the anode 4 can also flow in the coil 11 to generate a magnetic field between the cathode 3 and the anode 4 substantially parallel to the direction in which electrons flow from the cathode 3 to the anode 4 during the operation of the switch.

The operation of the first embodiment will be described below.

When a light is incident on the window 8 in a state where a voltage is applied between the cathode 3 and the anode 4 from the power source 13, electrons are generated in the space 5 in the cathode, generating a discharge between the cathode 3 and the anode 4 and hence a current flow between the cathode 3 and the anode 4 by the electron current 10.

At that time, the current from the power source 13 also flows in the coil 11, generating a magnetic field between the cathode 3 and the anode 4. The direction of the lines of magnetic force 12 in the magnetic field generated between the cathode 3 and the anode 4 is substantially parallel to the direction in which the electron current 10 flows between the cathode 3 and the anode 4. Consequently, the electrons directed from the cathode 3 to the anode 4 are confined to move along the lines of magnetic force 12 in the magnetic field.

The lines of magnetic force 12 in the magnetic field are distributed over the entire surface of each of the flat electrodes 1 constituting the cathode 3 and the anode 4. Accordingly, the electron current 10 is diffused over the surface of the flat electrode 1, and confinement of the electron current 10 due to self-pinch effect thereof is thus restricted.

As mentioned above, since the coil 11 for generating a magnetic field between the cathode 3 and the anode 4 substantially parallel to the direction in which electrons flow from the cathode 3 to the anode 4 during the operation of the switch is disposed on the outer side of the cylindrical insulator 7, confinement of the electron current 10 can be restricted. Therefore, even when the current value increases or when the energization time is prolonged, the temperature of the flat electrode 1 does not rise, and damage to the flat electrode 1 is thus eliminated. Also, attachment of an electrode substance to the inner wall surface of the cylindrical insulator 7 is eliminated, and deterioration in the discharge initiation characteristics and insulation characteristics is restricted while the reliability and lifetime are improved.

Furthermore, since a self-current of the switch is applied to the coil 11 to generate a magnetic field, it is not necessary for the power source exclusively used for the coil to be provided, thus reducing the size of the switch.

Figure 3:
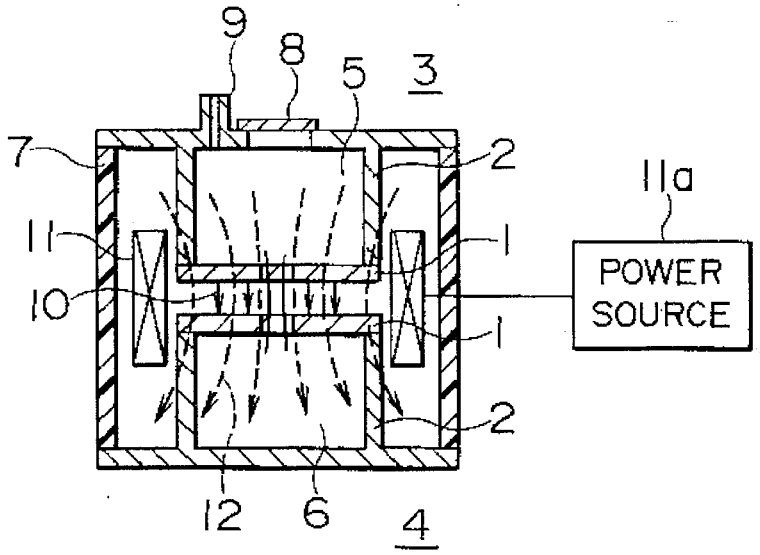
FIG. 3 is a cross-sectional view of a high current density glow discharge switch showing a third embodiment of the present invention.

Whereas the power source 13 is used to apply a voltage between the cathode 3 and the anode 4 and to supply power to the coil 11 in the first embodiment, a power source **11*a* exclusively used for the coil 11** is provided in the second embodiment, as shown in FIG. 3.

Whereas the coil 11 is disposed on the outer side of the cylindrical insulator 7 in the first embodiment, the coil 11 is disposed between the cylindrical insulator 7 and the cup-shaped electrodes 2 in a third embodiment of the present invention.

Figure 4:
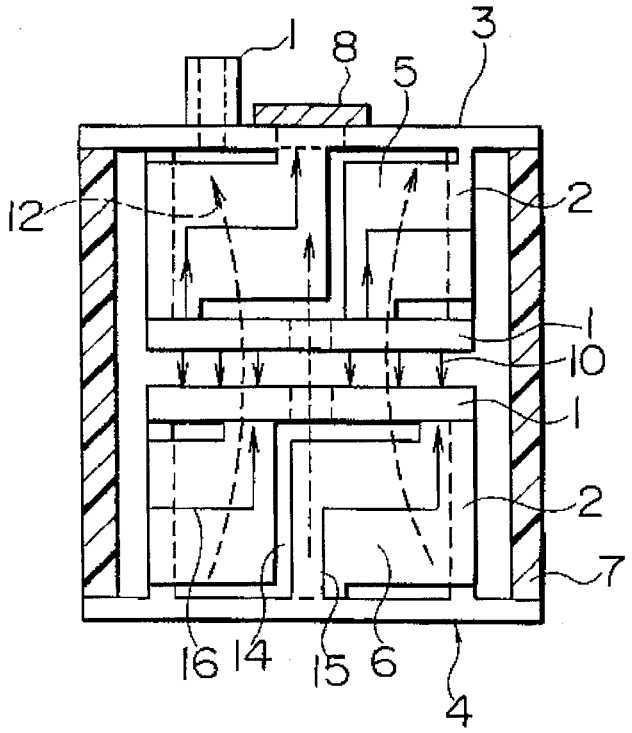
FIG. 4 is a broken side view of a high current density glow discharge switch showing a fourth embodiment of the present invention.
Figure 5:
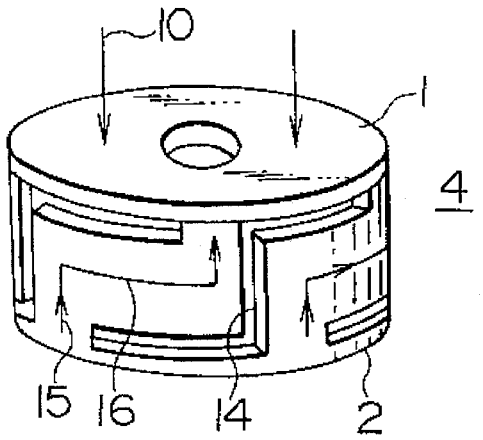
FIG. 5 is a perspective view of an anode of the high current density glow discharge switch of FIG. 4.

FIG. 4 is a broken side view of a high current density glow discharge switch showing a fourth embodiment of the present invention. FIG. 5 is a perspective view of an anode of the switch of FIG. 4.

In the fourth embodiment, the cup-shaped electrode 2 constituting the anode 4 has slits 14 formed in the side wall thereof. The slits 14 divide the side wall portion of the cup-shaped electrode 2 into four portions and thereby define current paths which ensure that a current 15 flowing in the cup-shaped electrode 2 has a current component 16 in the circumferential direction of the cup-shaped electrode 2 and that the current components 16 are directed in the same direction. Similarly, the cup-shaped electrode 2 constituting the cathode electrode 3 has slits 14 formed in the side wall thereof. The slits divide the side wall portion into four portions and thereby define current paths which ensure that the current components 16 are directed in the same direction as that of the current components 16 of the anode 4.

The operation of the fourth embodiment will be described below.

When a light is incident on the window 8 in a state where a voltage is applied between the cathode 3 and the anode 4, electrons are generated in the space 5 in the cathode, generating a discharge between the cathode 3 and the anode 4.

Thus, a current flows between the cathode 3 and the anode 4 by the electron current 10. This current flows in the cup-shaped electrodes of the cathode 3 and anode 4 along the current paths which are defined by the slits 14 and are directed in the circumferential direction of the cup-shaped electrodes 2.

At that time, the current components 16 in the circumferential direction flow in the cup-shaped electrodes 2 constituting the cathode 3 and the anode 4, generating a magnetic field between the cathode 3 and the anode 4 substantially parallel to the direction of the flow of the electron current 10.

As mentioned above, in the fourth embodiment, the cup-shaped electrodes 2 constituting the cathode 3 and the anode 4 have the slits 14 formed in the side walls thereof in such a manner that the slits 14 divide the side wall portion and thereby define the current paths in the circumferential direction. Accordingly, the fourth embodiment has the same advantages as those of the first embodiment. In addition, the provision of the coil 11 is eliminated, and this reduces the size of the switch.

Figure 6:
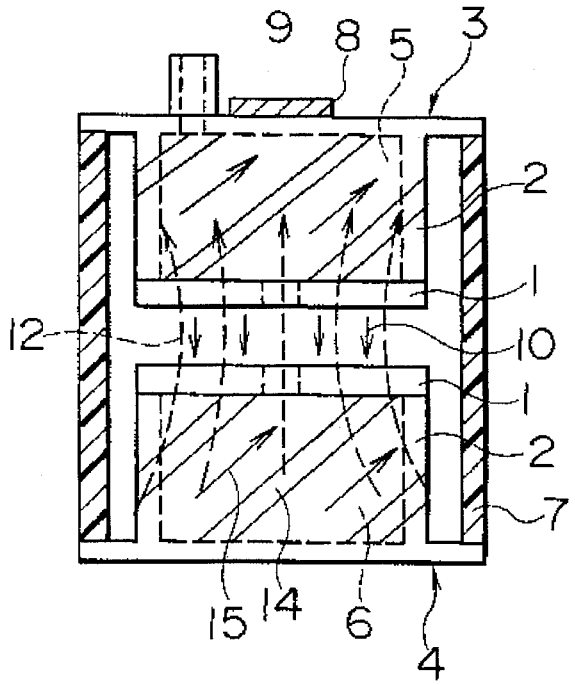
FIG. 6 is a broken side view of a high current density glow discharge switch showing a fifth embodiment of the present invention.
Figure 7:
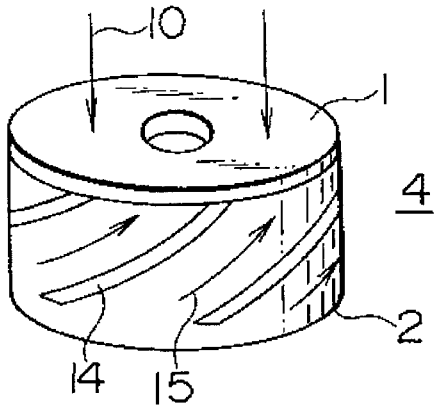
FIG. 7 is a perspective view of an anode of the high current density glow discharge switch of FIG. 6.
Figure 8:
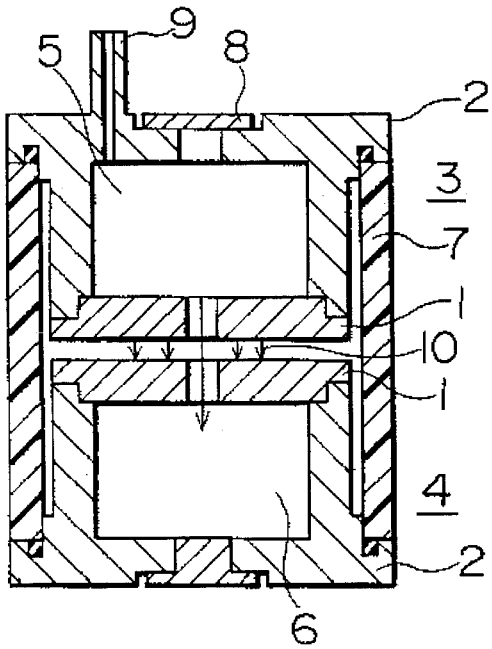
FIG. 8 PRIOR ART
FIG. 8 is a cross-sectional view of a conventional high current density glow discharge switch.

FIG. 6 is a broken side view of the high current density glow discharge switch showing a fifth embodiment of the present invention. FIG. 7 is a perspective view of the anode of the switch of FIG. 6.

Whereas the side wall of each of the cup-shaped electrodes 2 is divided by the slits 14 to define the current paths in the circumferential direction in the fourth embodiment, the side wall of each of the cup-shaped electrodes 2 is obliquely divided into four portions by oblique slits 14 in the fifth embodiment. The structure is as advantageous as the fourth embodiment.

In the aforementioned embodiments, the slits 14 are formed in the side wall of the cup-shaped electrode 2 to divide the side wall portion thereof into four portions such that the current paths in the circumferential direction can be defined and thereby divide all the current which flows in the cup-shaped electrode 2 into four current flows 15. In a sixth embodiment, a slit 14 is formed in the side wall of the cup-shaped electrode 2 in such a manner that a single coiled current path can be formed. Thus, all the current flowing in the cup-shaped electrode 2 flows along the single coiled current path.

In any of the aforementioned embodiments, hydrogen gas is filled in the sealed space formed by the cylindrical insulator 7, the cathode 3 and the anode 4. However, the charged gas is not limited to hydrogen gas but helium, neon, xenon, argon, nitrogen, carbon dioxide, sulfur hexafluoride, dried air or a mixture of any combination of these gases can also be used.

The present invention arranged in the manner described above has the following advantages.

In the present invention, since the magnetic field generation means for generating a magnetic field between the cathode and the anode substantially parallel to the direction in which electrons flow from the cathode to the anode during the operation of the switch is provided, confinement of the electron current flowing from the cathode to the anode to the vicinity of the center of the flat electrode is restricted by the magnetic field generated by the magnetic field generation means, restricting an increase in the temperature of the flat electrode and thereby reducing damage to the flat electrode and attachment of the electrode substance to the cylindrical insulator. As a result, a stable switching operation can be obtained, and reliability and lifetime of the switch can be improved.

In a preferred form of the present invention, since a slit is formed in the side wall of the cup-shaped electrode to divide the side wall portion and thereby define a current path which ensures that the current flowing in the side wall portion has a component in the circumferential direction of the cup-shaped electrode, the current which flows in the cup-shaped electrode has a circumferential component, and this allows a magnetic field to be generated between the cathode and the anode substantially parallel to the direction in which electrons flow from the cathode to the anode. Consequently, the use of a special magnetic field generation means is not necessary, and the size of the switch can be reduced.

What is claimed is:

1. A high current density glow discharge switch, comprising:

an evacuated sealed vessel filled with a gas;

a cathode and an anode which are fixedly disposed within said sealed vessel in such a manner that they face each other and that they are separated to form a discharge area;

a window provided in said cathode to introduce a glow discharge initiating light through said cathode; and magnetic field generation means for generating a magnetic field within said discharge area in a direction substantially parallel to a direction in which an electron current flows between said cathode and said anode and distributed over substantially an entire surface of each of said cathode and said anode such that the electron current flowing between said cathode and said anode is immediately and evenly diffused over substantially the entire surfaces thereof.

2. A high current density glow discharge switch according to claim 1 wherein said magnetic field generation means has a coil series-connected to said cathode and said anode.

3. A high current density glow discharge switch according to claim 1 wherein said magnetic field generation means has a coil driven by a current other than a current which flows in said cathode and said anode.

4. A high current density glow discharge switch according to claim 1 wherein said magnetic field generation means comprises a coil provided outside of said evacuated sealed vessel.

5. A high current density glow discharge switch according to claim 1 wherein said magnetic field generation means comprises a coil provided within said evacuated sealed vessel.

6. A high current density glow discharge switch according to claim 1 wherein said magnetic field generation means comprises a current path formed in a side wall portion of each of a plurality of cup-shaped electrodes constituting said cathode and said anode by a slit, said current path having a form which ensures that a current flowing in said side wall portion has a component in a circumferential direction of said cup-shaped electrode, and current components flow through the cathode in the same direction that current components flow through the anode.

7. A high current density glow discharge switch according to claim 6 wherein said current path formed by the slit has a crank-shaped form.

8. A high current density glow discharge switch according to claim 6 wherein said current path formed by the slit has an oblique form.

9. A high current density glow discharge switch in which a cathode and an anode, each of which includes a flat electrode having a central hole and a cup-shaped electrode electrically connected to said flat electrode, are fixedly disposed within a sealed vessel in such a manner that said flat electrodes face each other, and in which a gas is filled in said sealed vessel, the improvement comprising a magnetic field generation means for generating a magnetic field between said cathode and said anode substantially parallel to a direction in which an electron current flows from said cathode to said anode during an operation of said switch and distributed over substantially an entire surface of each of said cathode and said anode such that the electron current is immediately and evenly diffused over substantially the entire surfaces thereof.

* * * * *